US007950074B2

(12) United States Patent
Loizzo

(10) Patent No.: US 7,950,074 B2
(45) Date of Patent: May 31, 2011

(54) HARD HAT OUTER SHELL HAVING CLEAR ACRYLIC CONSTRUCTION AND INTERNAL ILLUMINATION

(75) Inventor: Larry J. Loizzo, Janesville, WI (US)

(73) Assignee: W.W. Grainger, Inc., Lake Forest, IL (US)

( * ) Notice: Subject to any disclaimer, the term of this patent is extended or adjusted under 35 U.S.C. 154(b) by 667 days.

(21) Appl. No.: 11/901,935

(22) Filed: Sep. 19, 2007

(65) Prior Publication Data

US 2008/0066218 A1 Mar. 20, 2008

Related U.S. Application Data

(60) Provisional application No. 60/845,629, filed on Sep. 19, 2006.

(51) Int. Cl.
*A42B 1/08* (2006.01)

(52) U.S. Cl. ..... 2/422; 362/106

(58) Field of Classification Search ..... 2/410, 422, 2/9, 6.2, 423; 362/106, 105, 570
See application file for complete search history.

(56) References Cited

U.S. PATENT DOCUMENTS

| | | | | |
|---|---|---|---|---|
| 3,358,137 | A * | 12/1967 | Sinclair et al. | 362/106 |
| 4,521,831 | A * | 6/1985 | Thayer | 362/570 |
| 5,014,366 | A | 5/1991 | Discipio, Sr. | |
| 5,327,587 | A * | 7/1994 | Hurwitz | 2/422 |
| D354,160 | S | 1/1995 | Shaffer | |
| 5,416,675 | A * | 5/1995 | DeBeaux | 362/106 |
| 5,426,792 | A * | 6/1995 | Murasko | 2/422 |
| 5,479,325 | A * | 12/1995 | Chien | 362/105 |
| 5,544,027 | A | 8/1996 | Orsano | |
| 5,758,947 | A * | 6/1998 | Glatt | 362/105 |
| 5,810,467 | A * | 9/1998 | Hurwitz | 362/106 |
| 5,871,271 | A * | 2/1999 | Chien | 362/106 |
| 6,113,244 | A * | 9/2000 | Baumgartner | 362/106 |
| 6,497,493 | B1 * | 12/2002 | Theisen | 362/105 |
| 6,644,826 | B1 * | 11/2003 | Blum | 362/183 |
| 6,968,574 | B2 * | 11/2005 | Kroll | 2/410 |
| 7,075,250 | B2 | 7/2006 | Colwell | |
| 2002/0157165 | A1 * | 10/2002 | Kroll et al. | 2/69 |
| 2002/0157173 | A1 * | 10/2002 | Murasko et al. | 2/425 |
| 2007/0261153 | A1 * | 11/2007 | Wise et al. | 2/423 |

FOREIGN PATENT DOCUMENTS

| | | | |
|---|---|---|---|
| JP | 06158412 | A * | 6/1994 |
| JP | 406158412 | A1 * | 6/1994 |

OTHER PUBLICATIONS

International Safety Equipment Association, American National Standard for Industrial Head Protection, ANSI Z89.1-2003, 2003, 16 pages.

* cited by examiner

*Primary Examiner* — Katherine Moran
*Assistant Examiner* — Richale L Quinn
(74) *Attorney, Agent, or Firm* — Greenberg Traurig, LLP

(57) ABSTRACT

A hard hat which includes an outer shell constructed entirely of clear acrylic that is additionally provided with a means to internally illuminate the clear acrylic outer shell.

10 Claims, 1 Drawing Sheet

HARD HAT OUTER SHELL HAVING CLEAR ACRYLIC CONSTRUCTION AND INTERNAL ILLUMINATION

BACKGROUND

In the art various methods for constructing hard hats or safety helmets are known. For example, U.S. Pat. No. 5,810,467 describes an illuminated protective hard hat that includes an electroluminescent lamp that is secured to the outside of an outer shell of the hard hat. U.S. Pat. No. 5,544,027 describes a safety helmet in which a string of LEDs are affixed, using an adhesive, to an outer shell of the safety helmet. U.S. Pat. No. 5,871,271 describes a safety helmet having an outer shell wherein one or more LEDs are fitted into recesses formed in the outer shell of the safety helmet. U.S. Pat. No. 6,497,493 describes a hard hat having a mounting bracket for supporting a battery-powered light on an exterior portion of an outer shell of the hard hat. U.S. Pat. No. D354,160 illustrates a design for a hard hat and a hard hat liner. In addition, ANSI Z89.1-2003 of the American National Standard for Industrial Head Protection describes the physical requirements for protective hard hats. Each of these references is hereby incorporated by reference in its entirety.

SUMMARY

The subject invention is directed to an improved hard hat which includes an outer shell constructed entirely of clear acrylic that is additionally provided with a means to internally illuminate the clear acrylic outer shell. The various objects, advantages, features, properties and relationships of this improved hard hat will be obtained from the following detailed description and accompanying drawing that set forth illustrative embodiments that are indicative of the various ways in which the principles expressed hereinafter may be employed.

BRIEF DESCRIPTION OF THE DRAWINGS

For a better understanding of the improved hard hat described hereinafter reference may be had to preferred embodiments shown in the following drawings in which.

DETAILED DESCRIPTION

Figure 1:
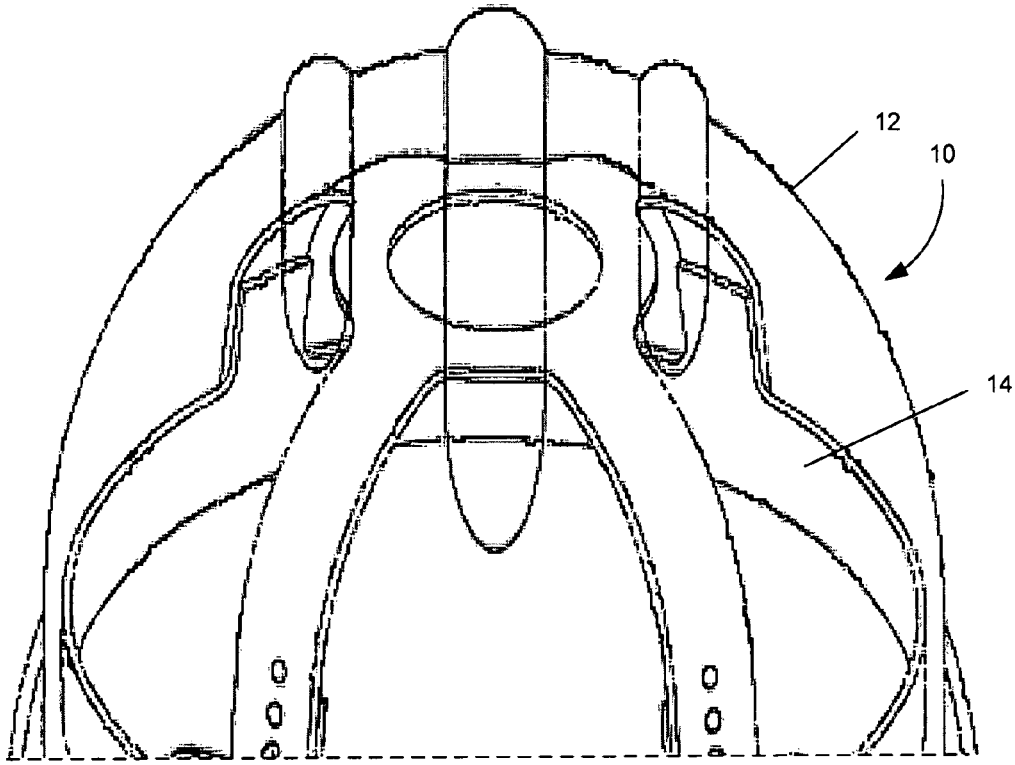
FIG. 1 illustrates a partial view of an exemplary hard hat having an outer shell constructed using a clear acrylic.

With reference to the figures, an improved hard hat is hereinafter described. As is conventional, the improved hard hat 10 includes an outer shell 12 and a harness 14. As will be understood, the harness 14 functions to maintain the hard hat 10 in correct wearing position on the head of a wearer and to act as an energy-absorbing mechanism. The entirety of the outer shell 12 is formed from a clear acrylic and, as such, the harness 14 will generally be visible through the outer shell 12 as illustrated in FIG. 1.

Figure 2:
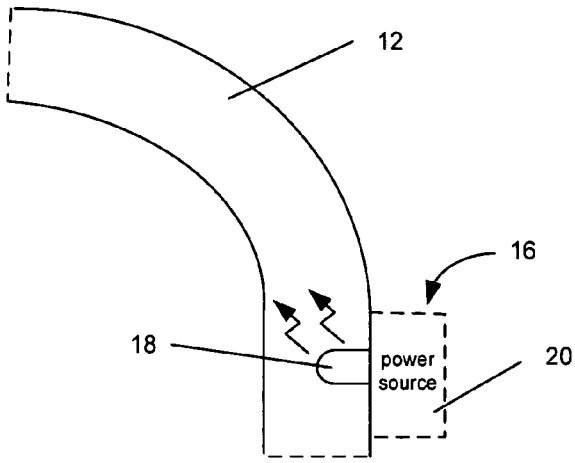
FIG. 2 illustrates a partial view of the hard hat of FIG. 1 wherein a first exemplary illumination system is utilized to internally illuminate the outer shell of the hard hat.
Figure 3:
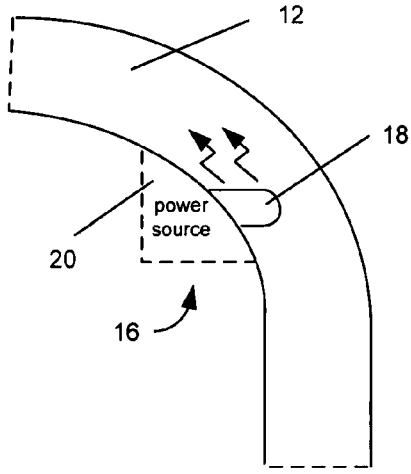
FIG. 3 illustrates a partial view of the hard hat of FIG. 1 wherein a second exemplary illumination system is utilized to internally illuminate the outer shell of the hard hat.

To internally illuminate the clear acrylic outer shell 12 of the helmet 10, an illumination device 16 is provided. The illumination device 16 is preferably in the form of an LED 18 that is fused into the clear acrylic outer shell 12. The LED 18 is powered by means of a power source 20 which may be in the form of batteries, a rechargeable power supply, etc. By way of example, the power source 20 may be attached to an exterior portion of the outer shell 12 of the helmet 10 as illustrated in FIG. 2. By way of further example, the power source 20 may be attached to an interior portion of the outer shell 12 of the helmet 10 in an area between the outer shell 12 and the harness 14 as illustrated in FIG. 3. In either case, the power source 20 may be releasably attached to the outer shell 12, for example by using clips, brackets, or the like, or may be integrally attached to the outer shell 12 and, if needed, provided with a releasable cover to thereby allow for replacement of batteries. For causing illumination of the LED 18, the power source 20 may be coupled to a manually operable switch. The power source 20 may also or alternatively be coupled to an automatic switch, such as a light sensing circuit, to allow for the turning on and off of the LED 18 based upon certain sensed conditions. The LED 18 may also be caused to be illuminated continuously and/or caused to blink as desired. Still further, the LED 18 may be a multicolored LED with a switch being used to select a particular color in which to internally illuminate the clear acrylic outer shell 12. While a single illumination device 16 with a single LED 18 is illustrated, it is to be understood that the hard hat 10 may support multiple illumination devices 16 and that the illumination device 16 may support more than one LED 18.

While specific embodiments of the improved hard hat have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A hard hat comprising:

an outer shell of unitary construction;

a harness directly attached to an interior surface of the outer shell; and an illumination device for illuminating the outer shell;

wherein the entirety of the outer shell is formed using a clear acrylic such that the entirety of the outer shell is transparent and the harness is thereby visible through the outer shell, wherein the illumination device comprises a light emitting diode (LED), and wherein the LED is positioned within and fused into the clear acrylic outer shell.

2. The hard hat as recited in claim 1, wherein the LED comprises a multicolor LED.

3. The hard hat as recited in claim 1, wherein the illumination device comprises a power source, wherein the power source is attached to an exterior surface of the clear acrylic outer shell, and wherein the power source is used to provide power for illuminating the LED.

4. The hard hat as recited in claim 3, wherein the power source is detachable from the exterior surface of the clear acrylic outer shell.

5. The hard hat as recited in claim 3, wherein the power source is rechargeable.

6. The hard hat as recited in claim 1 wherein the illumination device comprises a power source, wherein the power source is attached to the interior surface of the clear acrylic outer shell in an area that is between the outer shell and the harness, and wherein the power source is used to provide power for illuminating the LED.

7. The hard hat as recited in claim 6, wherein the power source is detachable from the interior surface of the clear acrylic outer shell.

8. The hard hat as recited in claim 6, wherein the power source is rechargeable.

9. The hard hat as recited in claim 1, wherein the illumination device comprises a light sensing circuit whereby the LED is caused to illuminate as a function of a sensed lighting condition.

10. The hard hat as recited in claim 1, wherein the LED is manually caused to be illuminated.

* * * * *